US009682351B2

(12) United States Patent
Jalenques

(10) Patent No.: US 9,682,351 B2
(45) Date of Patent: Jun. 20, 2017

(54) LABORATORY MIXER

(71) Applicant: Interscience, St Nom la Breteche (FR)

(72) Inventor: Emmanuel Jalenques, St Nom la Breteche (FR)

(73) Assignee: INTERSCIENCE, St Nom la Breteche (FR)

( * ) Notice: Subject to any disclaimer, the term of this patent is extended or adjusted under 35 U.S.C. 154(b) by 143 days.

(21) Appl. No.: 14/539,300

(22) Filed: Nov. 12, 2014

(65) Prior Publication Data

US 2015/0131404 A1 May 14, 2015

(30) Foreign Application Priority Data

Nov. 13, 2013 (FR) ..... 13 61085

(51) Int. Cl.
*B01F 13/04* (2006.01)
*B01F 11/00* (2006.01)

(52) U.S. Cl.
CPC ..... *B01F 13/04* (2013.01); *B01F 11/0065* (2013.01); *B01F 13/047* (2013.01); *B01F 2215/0037* (2013.01)

(58) Field of Classification Search
CPC ..... G01M 3/26; B01F 13/04; B01F 11/0065; B01F 13/047
USPC ..... 366/94; 73/40
See application file for complete search history.

(56) References Cited

U.S. PATENT DOCUMENTS 4,907,723 A * 3/1990 Katz ..... B67D 3/00 222/105
6,327,895 B1 * 12/2001 Jeppsson ..... A61M 1/28 604/29
2005/0162811 A1 * 7/2005 Obi ..... G02B 6/3584 361/437
2007/0220956 A1 * 9/2007 Terentiev ..... G01M 3/187 73/49.2

* cited by examiner

*Primary Examiner* — Tony G Soohoo
*Assistant Examiner* — Anshu Bhatia
(74) *Attorney, Agent, or Firm* — Thomas P. O'Connell; O'Connell Law Firm

(57) ABSTRACT

A laboratory mixer for mixing a sample and a diluent in a bag. An enclosure defines a mixing chamber, and at least one movable mixing element is retained for mixing the sample and the diluent within the bag. At least one liquid detector is retained relative to the enclosure for detecting liquid leaked from the bag. The sensor can be a capacitive, inductive, or optical sensor. The sensor can be a conductivity sensor with two electrodes shaped like combs and a gap less than or equal to a diameter of a drip of diluent solution. A ledge with a low point can be retained by an access door. The sensor or sensors can be disposed adjacent to the access door, on a mixing element, in direct contact with the bag, or on a tank. An alarm and cessation of operation can be triggered upon a detection of leaked liquid.

20 Claims, 3 Drawing Sheets

LABORATORY MIXER

RELATED APPLICATION

This application claims priority to French Application No. 1361085, filed Nov. 13, 2013.

FIELD OF THE INVENTION

The present invention relates generally to devices for use in analytical laboratories of the food, medical, cosmetic, chemical and pharmaceutical industries. More particularly, disclosed herein is a blade mixer for use in the preparation of microbiological samples contained in bags that are being prepared to be analyzed.

BACKGROUND OF THE INVENTION

Different types of laboratory mixers for the preparation of samples are known. Certain mixers are designed for the preparation of a sample before its microbiological analysis.

Typically, preparation of a sample to be analyzed begins with inserting the sample into a flexible sterile bag, usually made of a transparent plastic material. A diluent solution, usually physiological serum, is added to the bag. A supporting device, such as a blade mixer, can then be situated on a static surface and operated horizontally against the bag containing the sample to be analyzed.

The mechanism of a typical mixer consists of two blades. The blades grind the sample, if it is a solid, to homogenize the sample prior to microbiological investigation. However, the samples to be analyzed are often of various dimensions with varying external surfaces that may be sharp and jagged. As a result, the sterile bag may be pierced or a leak may be caused. In this regard, it will be noted that any contact between the sample and the inner parts of the mixer causes cross contamination. As a consequence, the entire preparation process must be restarted from the beginning, and the interior of the mixer must be completely cleaned.

A number of inventors have sought to provide improved mixers. Often, such inventors seek as a fundamental goal to preserve the integrity of the sample.

For example, French Patent No. 2795658 B1 describes a mixer that allows the mechanical action of the blades to adjust to the dimensions of the sample. With that, deterioration of the sterile bag is sought to be prevented. However, any adjustments are made at the discretion of the operator and are not guaranteed to be accurate or beneficial. Consequently, despite the adjustments, the mechanical action may still lead to leaks and accidental perforation.

In view of the foregoing, it will be appreciated that there is a continued need for a laboratory mixer for samples that enables an effective mixing of samples while avoiding piercing and other damage to the sample container and while preventing sample and apparatus contamination.

SUMMARY OF THE INVENTION

Accordingly and in view of the recognized and continuing needs relating to the preparation of microbiological samples, the present invention is founded on the basic object of providing a system and method for facilitating the preparation of microbiological samples contained in bags that avoids loss and contamination from piercing, leaking, and rupturing of sample containers, such as sample bags.

A further object of embodiments of the invention is to provide a system and method for the preparation of microbiological samples contained in bags that is efficient and reliable in operation.

Another object of certain embodiments of the invention is to provide a system and method for the preparation and mixing of microbiological samples that minimizes the need for remedial cleaning of the laboratory mixer and surrounding components and structures.

Still another object of embodiments of the invention is to provide a system and method for the preparation and mixing of microbiological samples that avoids waste and conserves time.

These and further objects and advantages of the present invention will become obvious not only to one who reviews the present specification and drawings but also to those who have an opportunity to experience an embodiment of laboratory dispenser disclosed herein in operation. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the aforementioned objects, one practice of the invention involves the preparation of samples contained in bags wherein a bag can be inserted into an enclosure delineating a mixing chamber. The bag and its relationship with the enclosure can be tight, and the bag can contain a sample and a diluting solution. The mixer has mixing features to mix the contents of the bag, such as the sample and the diluting solution. Even in basic embodiments, the mixer introduced in this invention offers to its users more efficiency in the preparation process of samples to be analyzed with an increased reliability of homogenization prior to sample analysis.

The laboratory mixer can further include one or more liquid detectors, which can be within the mixer enclosure. Preferably, the liquid detectors include at least one sensor located inside the mixer enclosure. It or they can be found in different locations or on different elements inside the mixing chamber. At least one sensor can be positioned in a pertinent position to quickly detect a loss of diluent solution. In this regard, it will be noted that, in the event of a puncture in the bag and due to movements of the mixing devices, the diluent solution can be projected in different directions. According to the invention, at least one of the sensors can be chosen from the group consisting of capacitive, inductive or optical sensors.

Advantageously, at least one sensor can be a conductivity sensor. Embodiments are contemplated wherein the sensor includes at least two electrodes forming an interval of at least one turn. This configuration is particularly adapted to this laboratory mixer application. It is further contemplated that the diluent solution could be salted thereby to conduct electricity. Advantageously, two comb-shaped electrodes could be interleaved. The electrodes could define a sinuous interval.

Preferably, at least one sensor can have two electrodes separated by a gap, which can represent the width of an interval, inferior or equal to the diameter of a drip of the diluent solution. In particular practices of the invention, the gap between two interleaved comb-shaped electrodes can be from 0.5 to 10 millimeters, even more preferably between 0.5 and 1.5 millimeters. In one further option, at least one of the interleaved comb-shaped sensors can be of random dimensions. In a still further option, at least one of the sensors can be equipped with gold-plated contacts.

Optionally, the current that goes through one of the sensors could be of low voltage. Additionally or alternatively, the current can be sent using impulsions to avoid corrosion. The current could be successively sent to the sensor, one terminal before the other, to avoid electrolyzing.

Preferably, the sensor can be fixed on a flexible substrate mounted on a mobile element of the mixer. The substrate can be extended by a tab supporting conductors connecting the sensor to electrical means installed in a fixed position in the mixer.

It is contemplated that the liquid detection sensors can be located on an access door within the enclosure, preferably located at a vertical median line of the door. It is further contemplated that one or more liquid detectors can be located on a ledge located inside the enclosure to support the bottom of the bag. This ledge can lead the dripping of the diluent solution to at least one collecting tank and one sensor.

The ledge can offer a low point, and liquid detection means can be located on it. The ledge can, in certain embodiments, be valley-shaped. For example, the ledge can be shaped like a V, the low point being the bottom of the V. The V-shape improves the draining of the diluent solution along the ledge to at least one of the sensors. The bottom of the V can correspond to a discharge manifold. In addition, the ledge can have at least one flange along the outer edge of the ledge opposite a bearing surface. The at least one flange helps guiding more diluting solution from the outer shell of the bag and the ledge to at least one sensor, thus preventing the diluent solution from dripping straight into the tank. The discharge collector guides the flow of the diluent solution once it has gone through at least one sensor.

Optionally, one or more liquid detectors can be located on at least one surface delineating the mixing chamber and adjacent to an access door of the enclosure, preferably near to the door. For example, one or more liquid detectors can be located on the same level with the mixing apparatus when they are fully deployed and operative, such as in direct contact with the bag.

Optionally, the liquid detector or detectors can be located directly on the mixing means. In fact, after a bag has been pierced due to movements of the mixing means, the diluent solution can spread on the bag and/or been projected on them. Preferably, mixing apparatus includes blades.

As taught herein, one or more liquid detectors can be in direct contact with the bag. Such a position grants an almost instantaneous detection of a leak, for at least one sensor is disposed in a pertinent manner. Still further, one or more liquid detectors can be located on at least one tank designed to collect leaks should a bag become breached.

Optionally, one or more liquid detectors can be located in a ledge tank, near the bottom of the V if it is a V-shaped ledge. In such embodiments, at least one sensor can be included that would require being fully-immersed or just a certain quantity of diluent solution to detect the leak. This embodiment also protects at least one sensor from any damage that could be inflicted, such as by a sharp sample, and this thanks to the relative distance between the bag and the bottom of the ledge tank. Such embodiments ease cleaning, avoiding spilling the diluent solution about the mixing chamber or the elements composing and within it.

Also according to this invention, one or more liquid detectors can activate, as soon as a leak of liquid is validated, an audible and/or visual alarm and/or an interruption of the mixing apparatus. The user can thus be warned of the failure of the sample preparation process without having to wait for it to end.

These features give to the invention several benefits. First, laboratory mixers embodying the invention improve the efficiency of the preparation process. In fact, the user will not lose time waiting for a sample that has become unusable. Moreover, the detection of leaks prevents from any excessive contamination of the mixing chamber and thus offers a gain of time when it comes to cleaning. In case the mixing process can be directly seen by the user, the user does not have to overview the process which may imply the possibility to work in masked-time. In addition, if the leak detection comes quickly, such as at the beginning of the mixing process, the sample may still be usable for a new preparation. On the other hand, mixers according to the invention can guarantee the reliability of the homogenization of the sample and the diluent solution. For example, mixers as taught herein can prevent the user from accidentally moving a leaking bag, which is contaminated, to another work station, in the perspective of the analysis for example.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention. It will thus be clear that additional features and benefits of the invention will be apparent through a reading of the detailed description of implementations and embodiments, which are without restriction, and by reference to the attached figures.

DETAILED DESCRIPTION OF PREFERRED EMBODIMENTS

The system and method for the preparation of microbiological samples disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Therefore, before any particular embodiment of the invention is explained in detail, it must be made clear that the following details of construction and illustrations of inventive concepts are mere examples of the many possible manifestations of the invention. The embodiments disclosed herein should not be considered as limiting. Indeed, variants of the invention are readily possible that would include only a selection of the features shown and described apart from the other described features.

Figure 1:
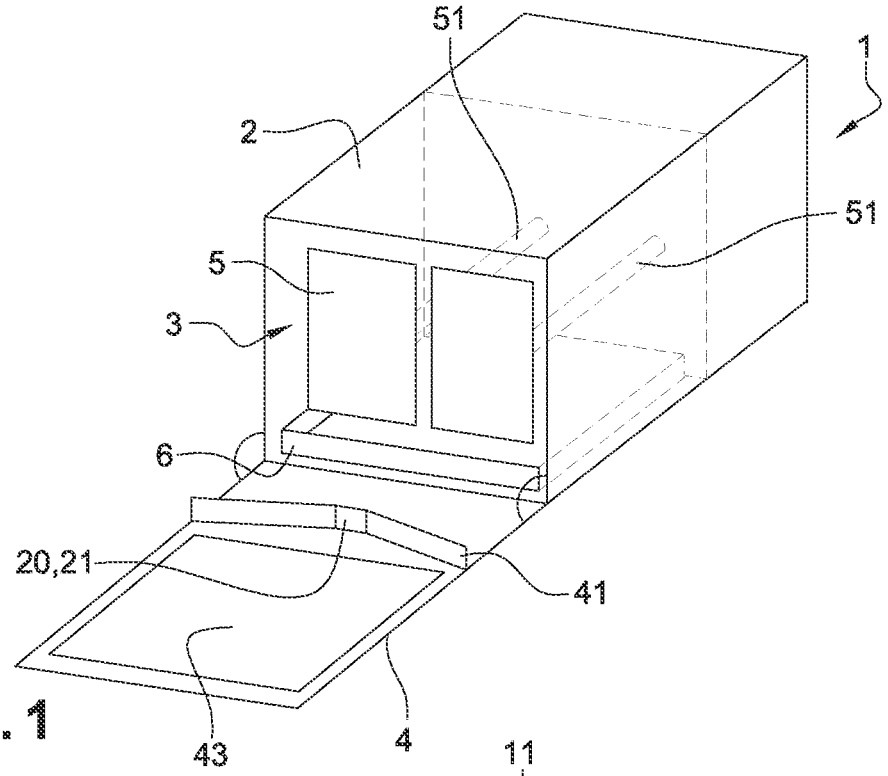
FIG. 1 is a schematic perspective view of a laboratory mixer according to the invention disclosed herein with the door of the mixer positioned for cleaning.
Figure 2:
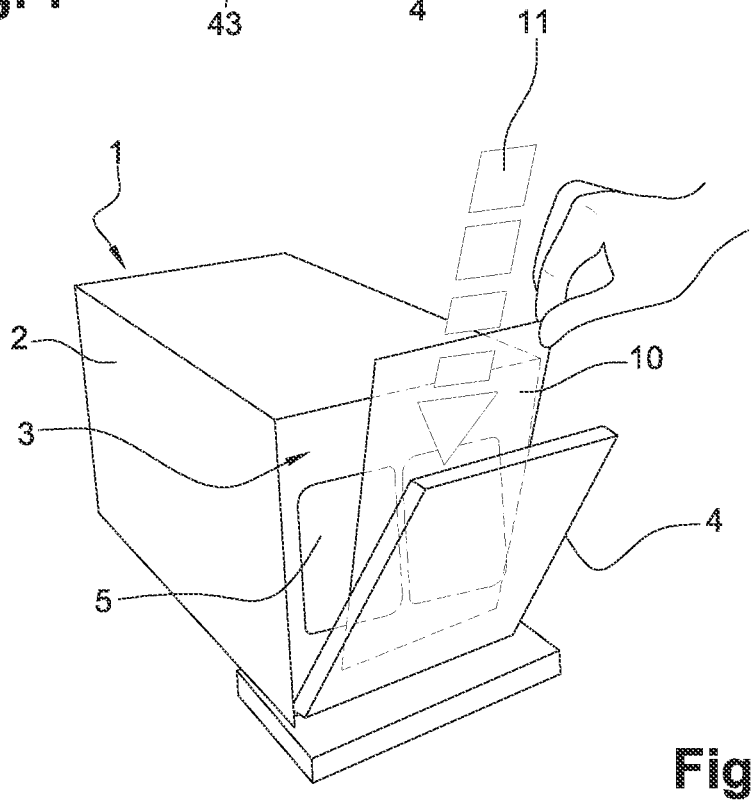
FIG. 2 is a schematic perspective view of a laboratory mixer as disclosed herein illustrating the door of the mixer positioned for fitting and removal of a bag.
Figure 3:
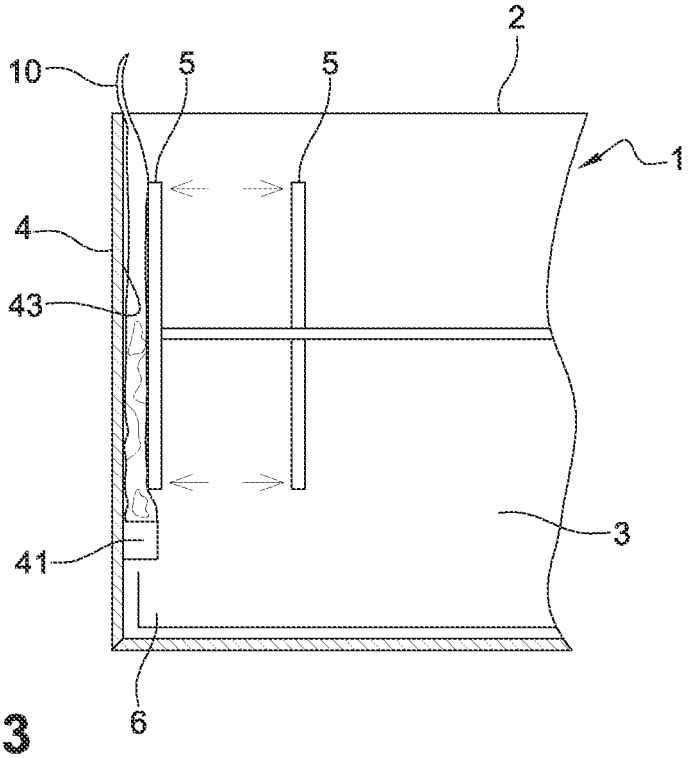
FIG. 3 is a sectioned view in side elevation of a portion of the laboratory mixer disclosed herein.

Looking more particularly to the drawings, an embodiment of the invention disclosed herein is depicted in FIGS. 1 through 3 in the form of a mixer for sample preparation, which is indicated generally at 1. The illustrated mixer 1 includes mixing members 5 positioned in a mixing chamber 3 and delineated by an enclosure 2. The mixing members 5 allow a bag 10 and the contents of the bag 10, such as a sample and a diluent solution, to be pressed, retained, and ultimately mixed by a pressing against a supporting surface 43 of the enclosure 2 in the mixer 1. The bag 10 can, for instance, be seen in FIGS. 2 and 3.

The mixing members 5 in this embodiment can be reciprocated toward and away from the supporting surface 43 to selectively, and with adjustable pressure, compress the bag 10 and its contents against the supporting surface 43 and, in doing so, to mix the contents of the bag 10. In the present embodiment, the mixing members 5 are plates or blades whose contact surfaces with the bag 10 are generally parallel to the supporting surface 43. The mixing members 5 may alternatively be referred to as retaining elements, plates, or blades or mixing plates or blades 5.

The operation of a mixing member actuation and control apparatus 51 can be such that, when one mixing member 5 moves toward the support surface 43 and increases its compression of the bag 10, another mixing member 5 can deviate away from the supporting surface 43 and decrease its compression of the bag. As one skilled in the art will readily appreciate by reference to the present disclosure, the actuation and control apparatus 51 could pursue multiple different forms within the scope of the invention. The actuation and control apparatus 51 can selectively reciprocate or otherwise move the mixing members 5 in an alternating, simultaneous, intermittent, continuous or other movement pattern.

In the present embodiment, the mixing members 5 consist of two mixing plates or blades. At least in certain practices of the invention, the supporting surface 43 and the mixing members 5 can be generally vertically disposed with generally vertically disposed plate surfaces. A tank 6 can be positioned below the mixing members 5 to collect leakage from the mix of the sample and diluent solution.

In a preferred embodiment, the enclosure 2 of the mixer 1 can retain an access door 4. The access door 4 can be designed as an access path to the mixing chamber 3 and can retain the supporting surface 43. As depicted in FIG. 3, for example, the door 4, which can be a glass door, is positioned vertically when closed for mixing, and pivots downwardly about a horizontal hinge axis to reach an opening position, such as a position of a 70° inclination, to permit insertion and removal of a bag 10 as shown, for instance, in FIG. 2, and even to a horizontal position for cleaning as shown, for instance, in FIG. 1.

In certain embodiments of the invention, one or more liquid detectors 20 can be located inside the enclosure 2 of the mixer 1 to detect liquids, such as the diluent solution, that may have leaked outside of the bag 10. The liquid detector or detectors 20 can include at least one sensor 21 practically positioned and retained to increase its chances of being in contact with any diluent solution dripping from a bag 10 that is breached during mixing. In such a situation, the sensor 21 can transmit a signal to a controlling system, which can include an electronic card, to trigger, for example, cancellation of the mixing operation and/or an audible and/or a visual alarm to alerts the user that preparation has failed.

In the present embodiment, the door 4, as shown for example in FIGS. 1 to 3, retains a ledge 41. The ledge 41 can act as a vertical support for the bottom of the bag 10 during mixing. The ledge 41 can hold the bag 10 in position against the operative mixing members 5. The ledge 41 could, for example, extend generally perpendicularly from the supporting surface 43 of the door 4.

By way of example and not limitation, FIG. 2 shows a user inserting a bag 10 containing a sample and a diluent solution along an insertion path generally indicated at 11. The diluent solution could generally be a saline solution, such as physiological serum. The bag 10 can be inserted into the mixer 1 to permit a homogenization of the mixture before microbiological analysis. As a result of the door 4 being able to be opened, the user may slide the bag 10 along the door 4 to the ledge 41. The user can then close the door 4 of the mixer 1 before activating the mixing members 5.

In the present embodiment of the broader invention disclosed herein, FIG. 3 shows the mixer 1 as it might appear during the mixing process. The door 4 is closed, and the bag 10 is in contact with the door 4, the ledge 41, and at least one of the mixing members 5. During operation of the mixer 1, the mixing members 5 can intermittently, alternatingly, or otherwise press against the bag 10 along a generally horizontal trajectory, compressing it against the supporting surface 43 of the door 4. The sample can then be gradually grinded after each successive contact by the mixing members 5 and diluted in the diluent solution by means of the homogenization process.

In the event of a leak, such as if the bag 10 is pierced by a sharp-edged sample, the diluent solution will, due to gravity, tend to drip down the bag 10 and/or from the ledge 41 to reach at least one sensor 21, which again can be positioned to be below the bag 10 during operation of the mixer 1. In this way, it is possible to notice any loosely or poorly sealed bags, as well as any punctured or otherwise compromised bags, quickly thereby to minimize cleanup and wasted time and material.

The ledge 41 can be located at a given height from the bottom of the mixer 1. The ledge 6 can overlie the tank 6 in such a manner that any leaking solution not retained by the ledge 41 will tend to flow into the tank 6 located at the bottom of the mixing chamber 3.

Figure 4:
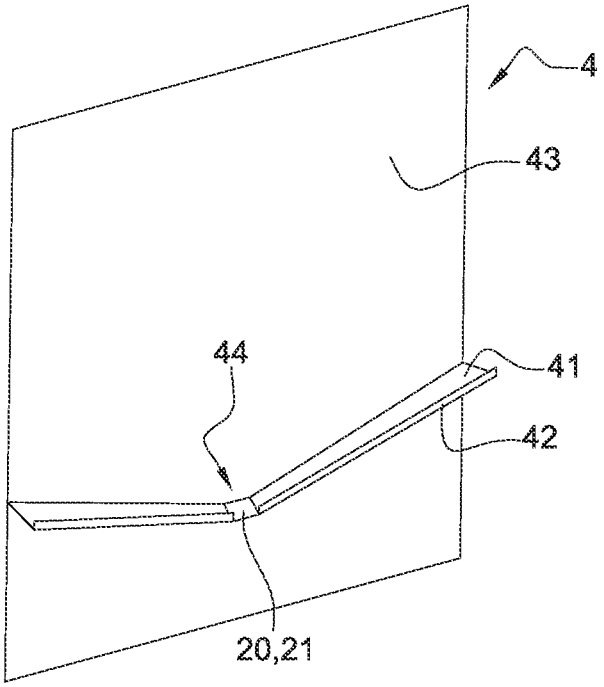
FIG. 4 is a perspective view of a door with a ledge for the laboratory mixer disclosed herein.

The inner face of the access door 4 can be seen perhaps most clearly in FIG. 4. There, one can see the ledge 41 affixed to the inner face of the access door 4. In the present embodiment, the ledge 41, more particularly at least the upper face of the ledge 41, can be seen to have a low-point 44 where any leaking liquid would tend to gather. In this example, the low-point 44 is located in an intermediate position, preferably at about midway along the ledge 41. For example, the ledge 41 can be shaped in a V-shape and can offer two slopes of similar length and steepness. The ledge 41 thus offers a support to the bottom of the bag 10 against gravity while controlling the flow of diluent solution or the sample mixed with it in case of a leak or a burst.

In a preferred embodiment, at least one sensor 21 can be located at or near the low-point 44 of the ledge 41. The sensor 21 can have a sensing face horizontally turned face-up. The ledge 41 can be channel-shaped and can offer one or more outboard ridges or sills 42 opposite to the supporting surface 43. In case of a leak, the sills 42 can offer better guidance of liquid dripping from the bag 10 and the ledge 41 toward the at least one sensor 21. With that, the chances of an early detection of any leak of liquid is increased, and diluent solution is guided toward but does not arbitrarily leak directly into the tank 6. Consequently, the intersection of the two slopes of the ledge 41 corresponds to a discharge collector with the ledge 41 acting as a throughway or a spillway.

Figure 5:
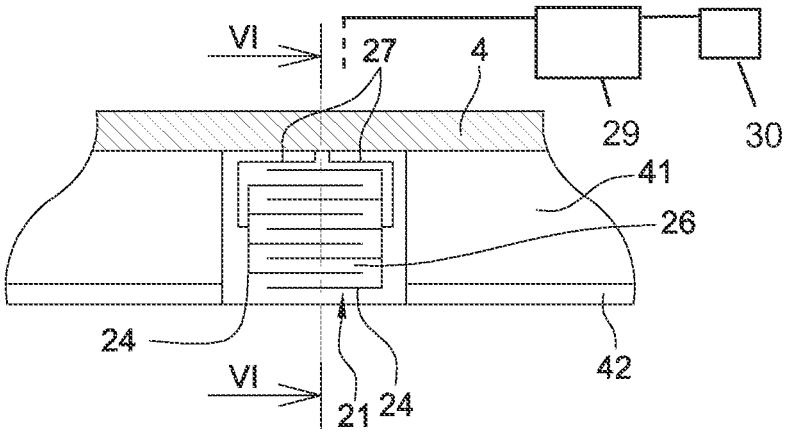
FIG. 5 is an amplified partial top plan view of the ledge of FIG. 4.

With reference to FIG. 5, the sensor or sensors 21 could, for example, be an electrically conductive sensor 21. The sensor 21 can, by way of example and not limitation, include two electrodes 24 fixed on an isolating substrate 22 that are normally isolated from one another. A gap 26 is established between the electrodes 24. When a drip of liquid bridges the gap 26, it connects the electrodes 24 electrically. A current is sent from one electrode 24 to the other and can be detected by an electrical monitoring system 29 of the mixer 1, which is shown schematically. This detection can generate the emission of an alarm signal from an alarm 30 and, additionally or alternatively, a shutdown of the mixing members 5.

The gap between the two electrodes 24, which means the width of the gap 26, can be less than or equal to the diameter of a drip of the diluent solution. This way, any drip can be detected, and the mixing members 5 can be stopped instantly, whether manually by a user or automatically. Leaking diluent solution can be prevented from continuing to spread in the mixing chamber 3.

The form of the electrodes 24 can be chosen so that the developed length of the gap 26 would as great as possible. The gap 26 can, for example, be made of one or several turns or even a sinuous shape of electrically conductive material. In the example depicted, each electrode 24 has a comb shape and the two combs face each other, interleaved to define a gap 26 that is sinuous and of a roughly equal width. Conductors 27 can connect the electrodes 24 to the electrical monitoring system 29 located in the mixer 1.

Figure 6:
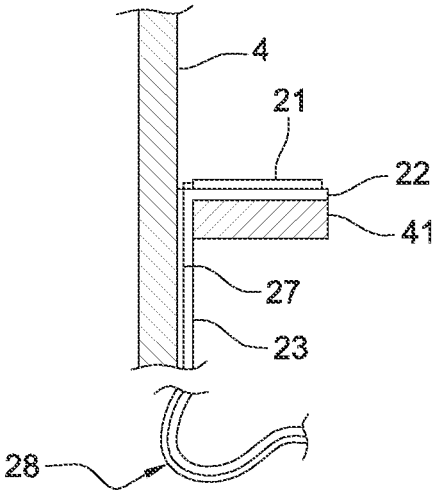
FIG. 6 is an amplified partial sectional view of the ledge taken along the line VI-VI in FIG. 5.

In the present embodiment, where one or more sensors 21 are mounted on a movable element, such as the door 4, the sensor 21, more particularly the electrodes 24 of the sensor 21, is fixed on a flexible substrate 22 which is itself mounted on the ledge 41 as can be seen in the cross-sectional view of FIG. 6. The substrate 22 is extended by a flexible tab 23 that supports the conductors 27, made flexible, and connecting the sensor 21 to the electric monitoring system 29 installed in a static position in the mixer 1. Also with reference to FIG. 6, starting from the sensor 21, the tab 23 bearing the conductors 27 can go to the articulation axis of the door 4 and form around it a loop 28 that can bend elastically when the door 4 is manipulated. In embodiments of the laboratory mixer 1, one or more sensors 21 can be chosen from the group formed by capacitive, inductive, and optical sensors.

Figure 7:
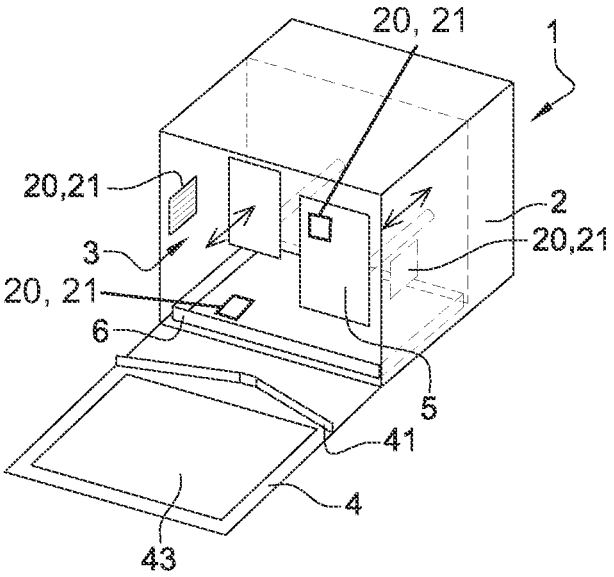
FIG. 7 is a perspective view of an alternative laboratory mixer according to the invention.

It is also contemplated that at least one sensor 21 can be retained on one of the surfaces delineating the mixing chamber 3 adjacent to the door 4. For example, as shown in FIG. 7, a sensor 21 can be located on each lateral wall of the mixing chamber 3 adjacent to the door 4. The sensor or sensors 21 can be close to the door 4 and, additionally or alternatively, near the mixing members 5 when they are on deployed in position for operation in contact with the bag 10. This embodiment is especially advantageous in case the bag 10 bursts and diluent solution is sprayed about the chamber 3.

In another embodiment, a sensor 21 can be mounted on a mixing member 5 or on each one of the mixing members 5 as shown, for instance, in FIG. 7. Thus, the sensor or sensors 21 can be disposed on one or both of the mixing elements 5 and, thus, in direct contact with the bag 10 during operation of the mixer 1. A sensor 21 could also be located on, in, or at the bottom of the tank 6, such as directly below a discharge drain of the ledge 41. The sensor 21 can be movable to enable extraction from the tank 6. One or more sensor 21 could additionally or alternatively be set on the door 4. Such a sensor 21 could extend the entire width of the door 4 so that, wherever the liquid may drip along the door 4, it would be detected. It is also within the scope of the invention, except as it might be expressly limited by the claims, for the electrodes 24 to be shaped in spiral form. In such embodiments, each loop of a first spiral can extend between two successive loops of a second spiral. Still further, at least one sensor 21 could be movable between two preparations.

With certain details and embodiments of the present invention for a laboratory mixer disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim:

1. A laboratory mixer for preparing a sample and a diluent solution stored in a bag, the mixer comprising:

a mixing chamber for receiving the bag containing the sample and the diluent solution wherein the mixing chamber comprises a supporting surface;

first and second movable mixing elements retained within the mixing chamber operative to mix the sample and the diluent solution within the bag from a disposition exterior to the bag wherein the first and second movable mixing are alternatingly reciprocable toward and away from the supporting surface whereby the bag containing the sample and the diluents solution can be disposed between the supporting surface of the mixing chamber and the first and second movable mixing elements and the sample and the diluents can be mixed by alternating reciprocation of the first and second movable mixing elements to compress the bag against the supporting surface intermittently;

wherein the first and second movable mixing elements have contact surfaces that are disposed generally parallel to the supporting surface and wherein the supporting surface and the contact surfaces of the first and second mixing elements are disposed generally vertically;

at least one liquid detector retained relative to the mixing chamber and exterior to the bag for detecting liquid leaked from the bag; and an electrical monitoring system electrically connected to the at least one liquid detector and wherein the first and second movable mixing elements are automatically stopped by the electrical monitoring system upon a detection of leaked liquid by the at least one liquid detector.

2. The mixer of claim 1 wherein the liquid detector comprises at least one sensor located in the mixing chamber of the mixer.

3. The mixer of claim 2 wherein the at least one sensor is chosen from the group consisting of capacitive, inductive, and optical sensors.

4. The mixer of claim 2 wherein the at least one sensor comprises a conductivity sensor.

5. The mixer of 2 wherein the sensor includes at least two electrodes with a gap between them.

6. The mixer of claim 5 wherein the at least two electrodes are fixed on a flexible substrate and wherein the at least two electrodes are shaped like combs.

7. The mixer of claim 5 wherein the at least one sensor has a gap between the at least two electrodes less than or equal to a diameter of a drip of diluent solution.

8. A laboratory mixer for preparing a sample and a diluent solution stored in a bag, the mixer comprising:

a mixing chamber for receiving the bag containing the sample and the diluent solution wherein the mixing chamber has a supporting surface;

at least one movable mixing element retained within the mixing chamber operative to mix the sample and the diluent solution within the bag from a disposition exterior to the bag wherein the at least one movable mixing element is reciprocable toward and away from the supporting surface whereby the bag containing the sample and the diluents solution can be disposed between the supporting surface of the mixing chamber and the at least one movable mixing element and the sample and the diluents can be mixed by a reciprocation of the at least one movable mixing element to compress the bag against the supporting surface intermittently; and at least one liquid detector retained relative to the mixing chamber for detecting liquid leaked from the bag wherein the liquid detector comprises at least one sensor located in the mixing chamber of the mixer wherein the sensor is fixed on a flexible substrate mounted on the at least one movable mixing element, and wherein the substrate has a tab supporting conductors that connects the sensor to electrical means installed in a static position inside the mixer.

9. A laboratory mixer for preparing a sample and a diluent solution stored in a bag, the mixer comprising:

a mixing chamber for receiving the bag containing the sample and the diluent solution wherein the mixing chamber has a supporting surface;

at least one movable mixing element retained within the mixing chamber operative to mix the sample and the diluent solution within the bag from a disposition exterior to the bag wherein the at least one movable mixing element is reciprocable toward and away from the supporting surface whereby the bag containing the sample and the diluents solution can be disposed between the supporting surface of the mixing chamber and the at least one movable mixing element and the sample and the diluents can be mixed by a reciprocation of the at least one movable mixing element to compress the bag against the supporting surface intermittently;

at least one liquid detector retained relative to the mixing chamber for detecting liquid leaked from the bag; and an access door coupled to the mixing chamber wherein the at least one liquid detector is retained by the access door and wherein the access door comprises at least a portion of the supporting surface.

10. The mixer of claim 9 further comprising a ledge retained within the mixing chamber to support the bag wherein the ledge projects into a space between the supporting surface and the at least one movable mixing element wherein the at least one liquid detector is at least partially retained by the ledge.

11. The mixer of claim 10 wherein the ledge is retained by the access door.

12. The mixer of claim 10 wherein the ledge has a low-point and wherein the at least one liquid detector is disposed at or adjacent to the low-point of the ledge.

13. The mixer of claim 10 wherein the ledge has the shape of a channel with ridges.

14. The mixer of claim 1 further comprising an access door coupled to the mixing chamber wherein the at least one liquid detector is disposed in the mixing chamber adjacent to the access door.

15. The mixer of claim 1 wherein the at least one liquid detector is located on the at least one movable mixing element.

16. The mixer of claim 1 wherein the at least one liquid detector is retained for direct contact with the bag.

17. The mixer of claim 1 further comprising at least one tank for collecting leaked liquid and wherein the at least one liquid detector is disposed on the at least one tank.

18. The mixer of claim 1 further comprising an alarm electrically connected to the electrical monitoring system and the at least one liquid detector and wherein the alarm is actuated upon a detection of leaked liquid by the at least one liquid detector.

19. The mixer of claim 1 further comprising an alarm electrically connected to the electrical monitoring system and the at least one liquid detector.

20. The mixer of claim 1 further comprising an enclosure wherein the mixing chamber is disposed within the enclosure.

* * * * *